US005438812A

United States Patent [19]

Erickson

[11] Patent Number: 5,438,812

[45] Date of Patent: Aug. 8, 1995

[54] HOLLOW VENEERED POLE

[75] Inventor: Robert W. Erickson, Minneapolis, Minn.

[73] Assignee: Regents of The University of Minnesota, Minneapolis, Minn.

[21] Appl. No.: 173,351

[22] Filed: Dec. 23, 1993

[51] Int. Cl.[6] ..... E04C 3/36

[52] U.S. Cl. ..... 52/736.3; 52/726.4; 52/DIG. 8; 52/233

[58] Field of Search ..... 52/726.4, 727, DIG. 8, 52/233

[56] References Cited

U.S. PATENT DOCUMENTS

| | | | |
|---|---|---|---|
| 3,200,554 | 8/1965 | Goodman et al. . | |
| 4,387,546 | 6/1983 | Kurita et al. . | |
| 4,428,792 | 1/1984 | Kurita et al. . | |
| 4,468,273 | 8/1984 | Eklund et al. . | |
| 4,522,006 | 6/1985 | Plikuhn | 52/233 |
| 4,897,140 | 1/1990 | Opsvik . | |
| 5,150,557 | 9/1992 | Gregory . | |

FOREIGN PATENT DOCUMENTS

| | | |
|---|---|---|
| 8002709 | 12/1980 | WIPO . |
| WO82/03240 | 9/1982 | WIPO . |

*Primary Examiner*—Carl D. Friedman
*Assistant Examiner*—Christopher T. Kent
*Attorney, Agent, or Firm*—Westman, Champlin & Kelly

[57] ABSTRACT

A hollow light weight pole like structure suitable for use as a utility pole, column or log building member is made of a plurality of wood strips glued edge to edge forming a hollow interior core, with at least one layer of high strength veneer material glued to the exterior of the wood strips with the veneer grain running parallel to the length. The layer of veneer increases the strength, distributes bending stresses uniformly, provides greater decay resistance than ordinary glued hollow poles, and increases the service life. The veneer can be made in several layers forming a continuous overwrap without longitudinally extending gaps that expose the interior wood strips to weather or splitting.

11 Claims, 2 Drawing Sheets 10
2
2

16
12
14
15
17

24
22
26
14
15
14
15
17
16
20
17
12
15
14
26
28
30

HOLLOW VENEERED POLE

BACKGROUND OF THE INVENTION

This invention relates to a hollow pole made up of a core of wood strips that are glued along mating edges and forming an enclosure around a central axis, with one or more layers of high strength veneer tightly wrapped and glued to the exterior of the core to provide a high strength pole. Power companies that require poles have tried to find a satisfactory substitute for a solid wood pole. Trees that will provide a long, solid pole are becoming unavailable and that means that costs are increasing. Likewise, more efficient use of wood has been recognized as a way of obtaining greater strength than a solid wood pole of similar dimensions.

Several efforts have been made to make a suitable hollow wood pole that is formed with a plurality of staves or strips that are glued together along their mating side edge surfaces around a central axis. For example, a hollow, wood stave pole made by using vacuum on the interior during gluing is shown in U.S. Pat. No. 4,468,273. Sealing caps are used for sealing the ends of the hollow pole so the interior vacuum can be created for gluing.

U.S. Pat. No. 4,428,792 shows a column made up of preformed multiple layers of glued veneer panels that can be wrapped around a solid core of wood. International publication WO80/02709 also shows a multiple stave, glued pole.

Other patents of general interest show pole structures that are hollow, such as the pole structure in U.S. Pat. No. 3,200,554 and a column used for construction shown in U.S. Pat. No. 4,387,546, which is similar to U.S. Pat. No. 4,428,792. Another pipe shaped structure is shown in U.S. Pat. No. 4,897,140.

U.S. Pat. No. 5,150,557 shows a column that is formed of two sections glued together. However, none of the patents illustrate a hollow stave pole core having a high strength, permanently mounted overwrap at the outer periphery, where the greatest contribution to bending strength is achieved.

SUMMARY OF THE INVENTION

The present invention relates to a hollow, wooden pole that is light weight and has high bending strength in relation to its weight and size. The pole comprises a core made of a plurality of longitudinally extending wood strips or staves that are glued edge to edge, and formed around a central axis to provide a hollow pole. The staves are generally trapezoidal shaped in cross section, with side edges abutting the next stave and intimately adhered thereto to form a rigid tubular pole core.

The staves can be tapered along their longitudinal length so that the pole has a generally conical shape, and after the staves are glued together with techniques that are known to form a core, the outer periphery can be smoothed so that the shape is generally circular at any cross section along the pole. This would mean removing some material at the exterior corners at the junctions between adjacent staves. Alternatively the staves can be machined prior to core formation to make the outer surface of the stave convex and with the right radius of curvature.

The pole core is then tightly wrapped with an overwrap of high strength, thin material, such as a wood veneer, or a suitable synthetic, glueable material that would have the ability to wrap tightly around the outer periphery of the pole core, taking into account the diameter of the pole. The overwrap of veneer is glued into intimate contact with the outer peripheral surface of the pole core. The veneer layers extend around the entire periphery, and the longitudinal seam of each veneer layer is positioned so that it does not coinside with the seams of the veneer sheets in the previous layers so that the outer peripheral surface of the staves forming the pole core are protected by the veneer layer or layers. If desired, several layers of overwrap veneer can be wrapped around the pole core, and preferably there would be at least three wrap layers.

The veneer layers are at the outer edge or surface of the pole, where the greatest contribution to bending strength is achieved. It is accepted that about 90% of the bending strength of a pole comes from the outer 22% of the pole diameter. The high strength veneer is at this location. The contacting, glued surfaces of adjacent staves are protected from weather elements; the staves themselves are protected from weather, and a great increase in strength is achieved by having the high strength outer veneer wrap integrally formed to the pole core. The grain of the veneer, if the veneer is wood, will be oriented parallel to the longitudinal axis of the pole.

A rigid, bend resistant pole made of staves of readily available wood and veneer is produced. The wood staves can be chemically treated faster, cheaper, and more thoroughly than conventional solid poles. The weight of the finished pole is reduced so that the erection of the pole is simplified. The poles can be made up with staves that are of a selected length so there are pole core sections of selected length which can be assembled for forming a full length pole. The individual staves also can be shorter than the core length, with the shorter staves interfitted with ends of other staves using finger joints. Thus, full length staves can be formed. Care is taken to stagger any end joints in the staves from end joints of adjacent staves.

The wood strip or stave cores can be joined end to end by the use of male and female threads, or other suitable junction members. The veneer wrapping provides the majority of the bending strength, and the edge and butt joints of the veneer sheets are staggered so that when using multiple layers no single joint extends all the way to the staves.

DETAILED DESCRIPTION OF THE PREFERRED EMBODIMENTS

Figures 1, 2, 3:
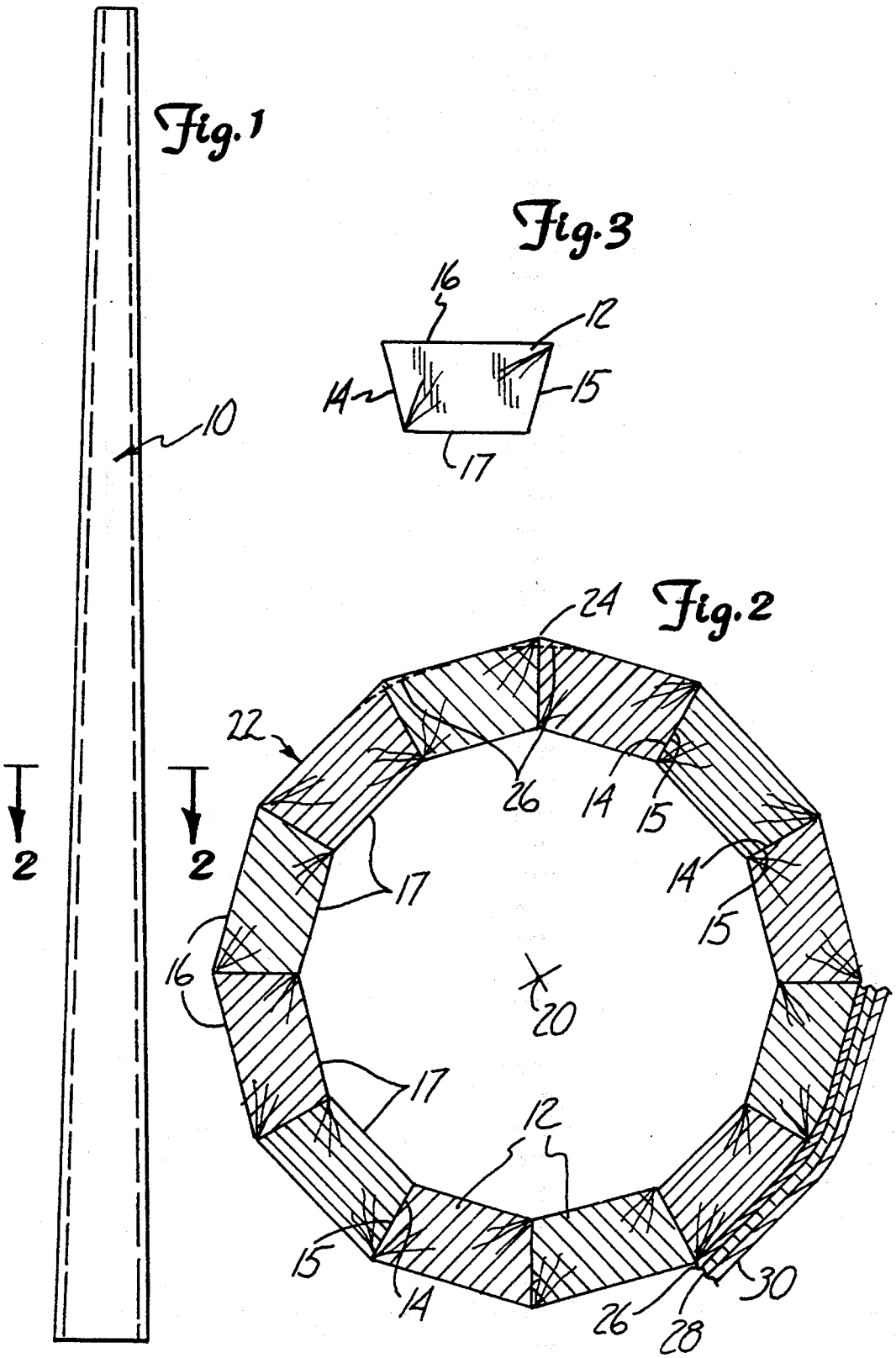
FIG. 1 is a side elevational view of a typical pole made according to the present invention.
FIG. 2 is a greatly enlarged cross sectional view taken as on line 2—2 in FIG. 1.
FIG. 3 is a cross sectional view of a wood strip or stave used manufacturing the pole of FIG. 1.
Figure 4:
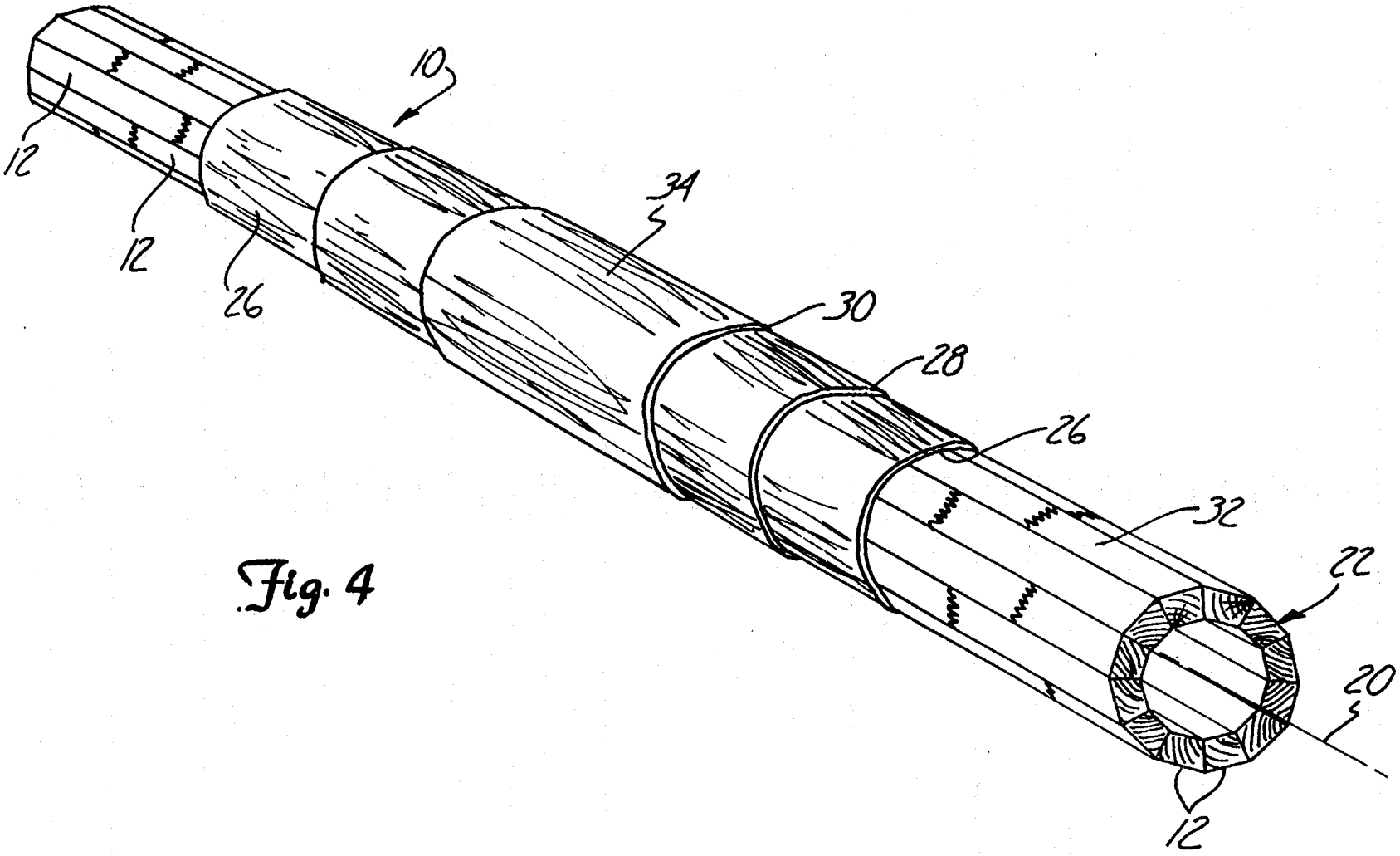
FIG. 4 is a perspective schematic view of a typical pole assembly made according to the present invention and showing the veneer overwraps thereon.

A utility pole or structural column indicated generally at 10 is made, according to the present invention, of a plurality of elongated wood staves or strips 12, that are generally trapezoidal in shape as shown in FIG. 3, and have side edge surfaces 14 and 15, an outer surface 16, and an inner surface 17. When glued with the side edge surfaces 14 abutting or contiguous with the edge surface 15 of an adjacent stave 12 as shown in FIG. 2, the assembly is a hollow, generally conical pole shaped core 22 generated around a central axis 20. The side edge surfaces 14 and 15 are at acute included angles relative to each other. Each stave is permanently adhered to the adjacent staves to form a continuous, elongated pole core of the desired length. The pole core 22, comprising the staves 12 joined together around the central axis 20, could be made in suitable lengths, which then can be joined end to end for making a pole 10 of adequate length and diameter.

The wood staves 12 can be made of any suitable wood, preferably underutilized species of hardwood. The staves 12 can be chemically treated for rot, insect infestation and the like before being glued together, or the entire pole can be treated after its manufacture. The lengths of the staves can be selected by using finger joints to join stave sections end to end.

Once the pole core 22 has been formed, preferably the exterior corner portions indicated generally at 24 (FIG. 2) between the adjacent staves 12 are removed by sanding or cutting to form a surface that is along the lines indicated at 26 and thus generally circular in cross section at any given cross section along the core 22 of the pole 10.

After the operation of removing the projecting exterior corner portions of the trapezoidal staves and forming a smooth circular cross section conical exterior surface, the core 22 is overwrapped with one or more layers of a suitable laminate or veneer, such as layers 26, 28, and 30, as shown. The first wrap layer 26 of veneer is in intimate contact with the outer peripheral surface 32 of the pole core 22, and is wrapped so that it is substantially encompasses the entire outer peripheral surface of the pole core and is glued to the outer peripheral surface. The veneer, if it is a wood veneer, generally is in the range of about 3/16 inch in thickness, and has its grain oriented to be parallel to the longitudinal axis 20 of the pole. High strength soft woods can be used for the veneer. Subsequent veneer layers 28 and 30 are also then intimately wrapped around the next adjacent inner layer and tightly glued or otherwise adhered with a suitable adhesive to the surface of the next interior veneer layer. Butt joints between the edges of the veneer, such as that shown at 34 on layer 30, are staggered longitudinally relative to the other veneer layers and with respect to other sheets in the same layer. The veneer layers have longitudinally extending joints which are annularly staggered so that the veneer layer joint does not overlie the junctions or seams between adjacent staves, or rather in the mid part of a stave outer surface, and also the joints of outer veneer layers do not directly overlie the longitudinal joint of another layer.

It is also possible to have a continuous wrapping of the veneer layers, with present machines. The layers would be a continuously wrapped sheet with only a beginning edge on the core, and an outer edge on the exterior.

When the veneer layers have been tightly adhered into position, the pole core 22 is sealed effectively from the weather, and the high strength veneer material layers, which can be a high strength wood, a polymer wrap, or a combination of the two, or other easily wrapped and relatively easily adhered materials, such as high strength synthetics sold under the trademark "FORMICA", or material known as KEVLAR will provide for a great increase in pole bending strength over that of unwrapped pole cores 22 of glued wood staves.

It has been accepted that about 90% of the bending strength comes from the outer 22% of the total pole diameter. The outer 2.2 inches of diameter of a 10 inch pole contributes 90% of the bending strength.

The composite pole of the present invention has numerous advantages. The wood contained is 50% or less compared to solid wood poles, and it can be engineered for strength requirement by selection of the materials, the thickness (number of layers) of overwrap and the material used for the veneer overwrap.

The energy intensive (and inadequate) drying for solid wood poles is eliminated. The weight of the pole is reduced substantially, for equal strength and size, and it is less energy intensive to manufacture than poles of concrete or steel, which are also quite heavy and form substitutes for wood poles. The cost of production of the pole of the present invention is in the range of one-half to perhaps two-thirds of that of an equal sized solid wood pole.

The staves 12 can be glued up using known machinery as illustrated in the prior art cited or using other known techniques. The strength of the veneer overwrap greatly increases the strength of the wood pole, as well as protecting it from the environment. The veneer overwrap may be clamped with band clamps or full length clamps during gluing to insure a good, strong glue joint. The clamps are removed after the glue has set, and additional veneer layers are added as desired. The glue used should be waterproof and compatible with the veneer material. The glue is permitted to fully cure before use of the pole.

The pole length can be selected as needed. Veneer layers are usually in 8 foot lengths in the grain direction, which are oriented with the 8 foot lengths along the pole with butt joints between lengths of veneer. The butt joints are staggered between successive veneer layers.

While the description has dealt with a "pole" or column, the structure of the present invention can be used as a log for log homes or as a conduit or pipe as well as a support for power lines or the like. If the structure is used for a log home, the outer veneer would have the desired grain or knotty appearance, and the pole could be made without a taper.

Although the present invention has been described with reference to preferred embodiments, workers skilled in the art will recognize that changes may be made in form and detail without departing from the spirit and scope of the invention.

What is claimed is:

1. A hollow elongated member comprising a plurality of elongated wood strips having generally trapezoidal cross sections with outer surfaces and side edge surfaces formed at an angle relative to each other so that when the plurality of strips are placed side to side, a hollow core is formed with a substantially continuous outer surface;

an adhesive for holding the wood strips in an assembled condition forming the hollow core; and at least one substantially continuous layer of high strength veneer material on the exterior of the formed hollow core extending throughout the length and periphery of the core to provide a high strength outer layer intimately, permanently secured on the core.

2. The hollow member of claim 1 wherein the member is a pole which tapers in diameter from a base end to an upper end.

3. The hollow member of claim 1 wherein there are a plurality of layers of veneer material permanently secured to the core and each other and positioned such that no seam in the veneer extends to the outer surfaces of the wood strips.

4. The hollow member of claim 1 in which the core has an outer periphery formed to be substantially circular in cross section over which at least one veneer layer is wrapped.

5. The hollow member of claim 1 wherein at least one veneer layer is a veneer made of straight grained wood, and the grain is parallel to the length of the wood strips.

6. The hollow member of claim 1 wherein the member manufactured without taper, such as for use in log cabin construction.

7. A pole like structure having an elongated axis forming a length, said structure being generated about an axis and having a hollow interior, the structure further comprising a plurality of generally trapezoidal cross section elongated wood strips glued side to side to form a core around the longitudinal axis;

the outer periphery of the wood strips forming the core having an exterior peripheral surface; and at least one layer of a high strength material bendable around a peripheral surface of the core and intimately adhered to the outer peripheral surface of the core to provide a high strength, thin, outer layer that protects the interfaces of the side surface of the wood strips and adds bending strength to the core.

8. The pole like structure of claim 7 wherein said bendable material is a wood veneer having a grain extending longitudinally of the pole like structure.

9. The pole of claim 7 wherein there are a plurality of layers of bendable material, each of said layers of material being glued to an underlying surface, with the first layer being glued to the peripheral surface of the core, and subsequent layers being glued to an outer surface of the next inner layer of material, to provide a high strength outer overwrap over the glued strips forming the core.

10. The pole like structure of claim 9 wherein said veneer overwrap extends substantially the full length of the pole like structure.

11. The pole like structure of claim 7 wherein the pole like structure is conically tapered from a base end to an outer end.

* * * * *